United States Patent [19]

Cook

[11] 3,945,151

[45] Mar. 23, 1976

[54] APPARATUS FOR REMOVING MORTAR FROM USED BRICK

[76] Inventor: Orville Lee Cook, Rte. 3, Strawberry Plains, Tenn. 37871

[22] Filed: Sept. 6, 1974

[21] Appl. No.: 500,250

[52] U.S. Cl. ..... 51/26; 51/80 A

[51] Int. Cl.[2] ..... B28D 1/00

[58] Field of Search..... 125/26; 51/76, 80 A, 80 B, 51/80 BS, 81 R, 140

[56] References Cited

UNITED STATES PATENTS

| | | | |
|---|---|---|---|
| 1,505,867 | 8/1924 | Cote | 125/26 X |
| 1,862,277 | 6/1932 | Moon | 51/76 R |
| 1,901,510 | 3/1933 | Hamann | 51/76 R X |
| 2,236,078 | 3/1941 | Walter | 51/76 R |
| 2,901,868 | 9/1959 | Price | 125/26 X |
| 3,169,352 | 2/1965 | Smith | 51/140 |
| 3,541,735 | 11/1970 | Schaller | 51/140 X |

*Primary Examiner*—Harold D. Whitehead
*Attorney, Agent, or Firm*—Fitch, Even, Tabin & Luedeka

[57] ABSTRACT

Apparatus for removing mortar from opposite flat faces of a used brick including means supporting the brick on one of its flat faces for forward movement along a path, means adapted to advance the brick forwardly including means adapted to engage the brick during such forward movement and guide means for the brick-engaging means, first grinding means disposed in position for the passage of the brick thereover during its forward movement and adapted to grind mortar from the bottom face of the brick as the brick is moved past the grinding means, means overlying the path of the brick adjacent the first grinding means and biased toward engagement with the brick to urge it toward the first grinding means, second grinding means disposed above the path of forward movement of the brick and adapted to grind mortar from the top face of the brick as it moves past the grinding means, and means mounting the second grinding means for generally vertical movement with respect to the path of the brick. A method is also disclosed.

4 Claims, 6 Drawing Figures

APPARATUS FOR REMOVING MORTAR FROM USED BRICK

This invention relates to apparatus for removing mortar from used bricks.

Bricks removed from old buildings or houses generally have a substantial commercial value because of their durability and aesthetic appeal. These used bricks, however, have varying quantities of mortar clinging to especially their opposite flat faces which make the bricks nonuniform in shape and size so that at least certain of the old mortar desirably is removed from the opposite flat surfaces of the bricks before the bricks are reused.

It is, therefore, an object of this invention to provide an apparatus and method for removing mortar from opposite flat surfaces of used bricks. It is another object of this invention to provide a method for removing the mortar from used brick. Other objects and advantages of the invention will become known by reference to the following description and the accompanying drawings wherein.

In accordance with the present invention, apparatus is provided for removing mortar from opposite flat surfaces of a used brick including means supporting the brick for forward movement along a path, means adapted to advance the brick forwardly, first grinding means disposed in position for the passage of the brick thereover during its forward movement and adapted to grind mortar from the bottom face of the brick as the brick is moved past the grinding means, means overlying the path of the brick adjacent the first grinding means and biased toward engagement with the brick to urge it toward the first grinding means, second grinding means disposed above the path of forward movement of the brick and adapted to grind mortar from the top flat face of the brick as it is moved past the grinding means, and means mounting the second grinding means for generally vertical movement with respect to the path of the brick.

In accordance with the method of the invention, a plurality of used brick are aligned on a planar supporting surface which defines a forward path of movement for the bricks, with one of the flat faces of each brick facing downwardly and its other flat face facing upwardly and preferably with the longitudinal dimension of each brick aligned substantially perpendicular to its direction of forward movement. Each aligned brick is moved forwardly passed a grinding station where the brick is urged against a rotating grinding means disposed in the path of the brick on the bottom side thereof. Thereafter the brick is moved forwardly to a second grinding station wherein a second grinding means is urged downwardly against the mortar on the top face of the brick to grind away mortar as the brick passes thereunder. The bricks with the mortar removed from their opposite flat faces are collected.

Figure 1:
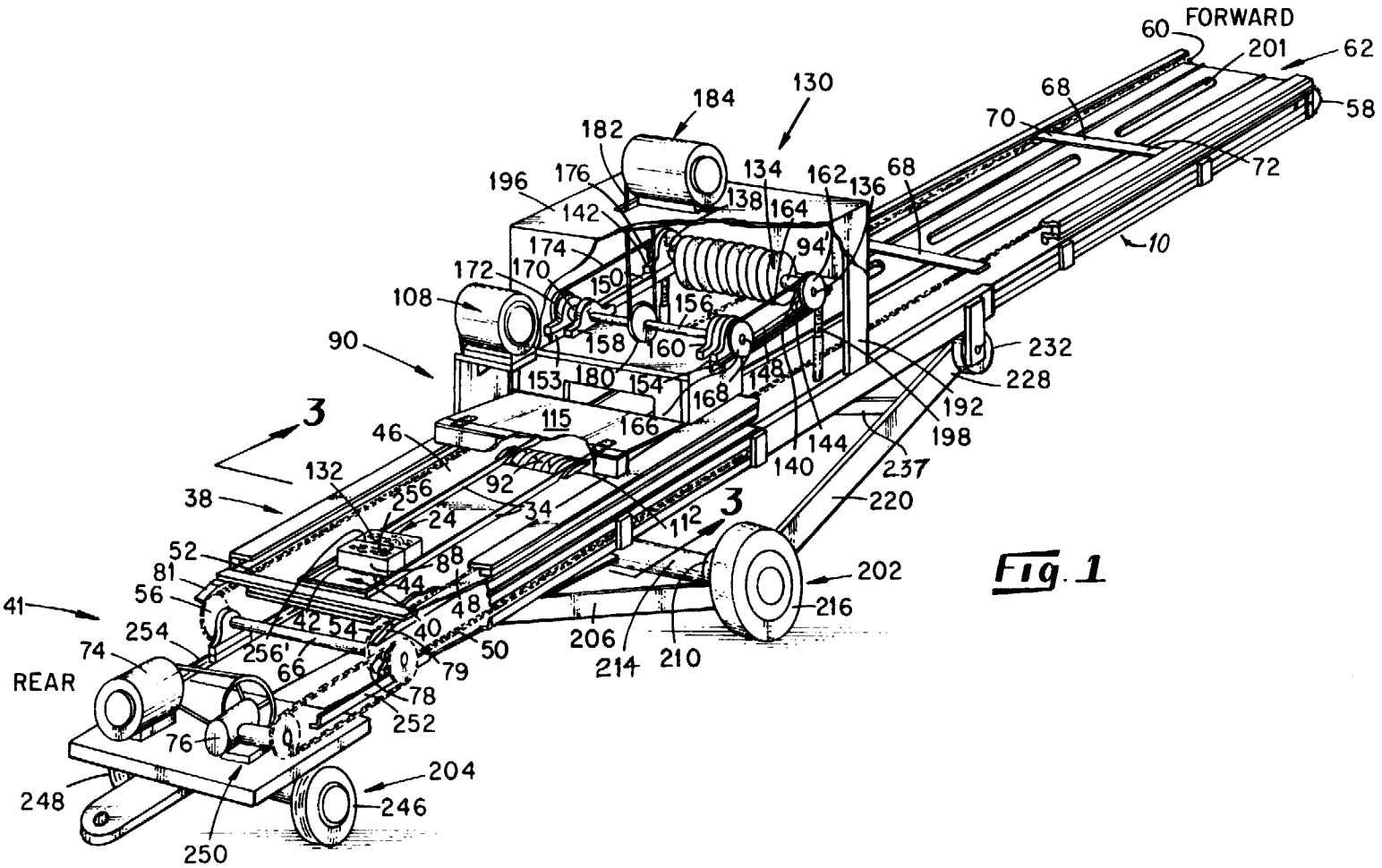
FIG. 1 is a perspective view of one embodiment of a device embodying various features of the invention.
Figure 6:
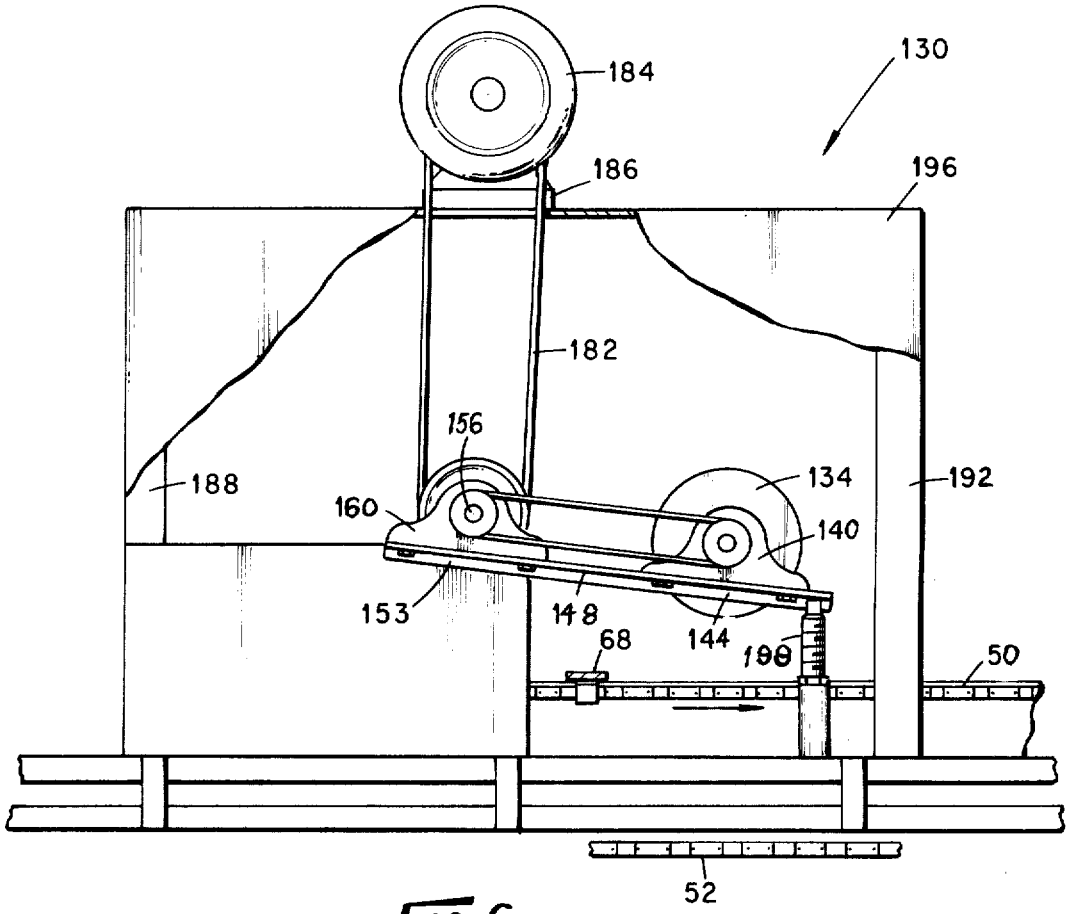
FIG. 6 is a fragmentary sectional side view, partly cut-away, of the second grinding station of the device shown in FIG. 1.
Figure 2:
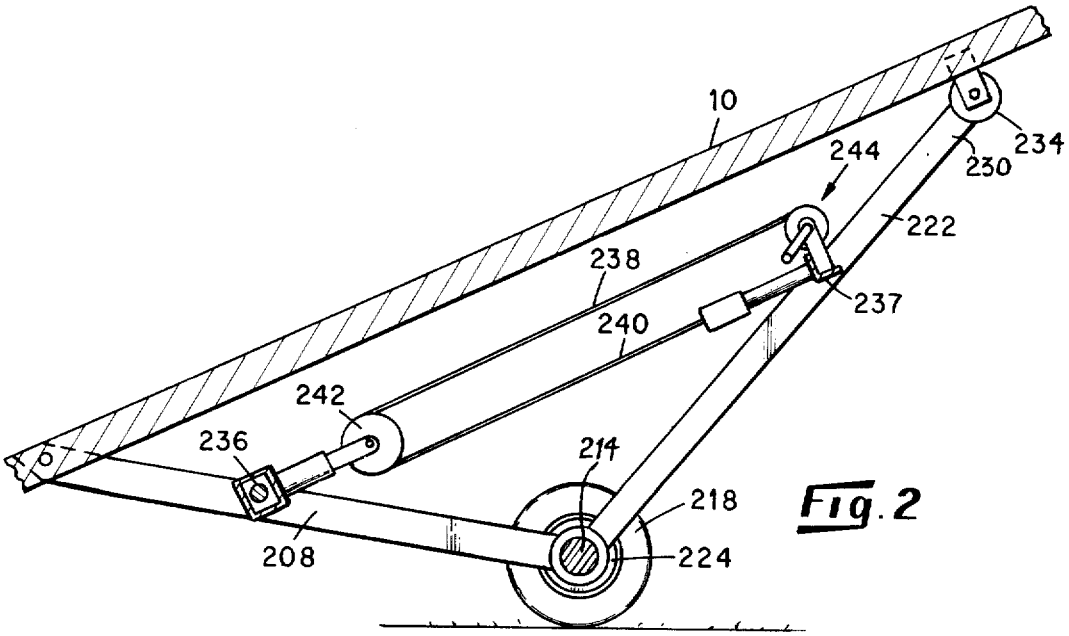
FIG. 2 is a schematic front side view, partly fragmentary and partly cut-away, of apparatus for adjusting the angle of elevation of the device of FIG. 1.
Figure 3:
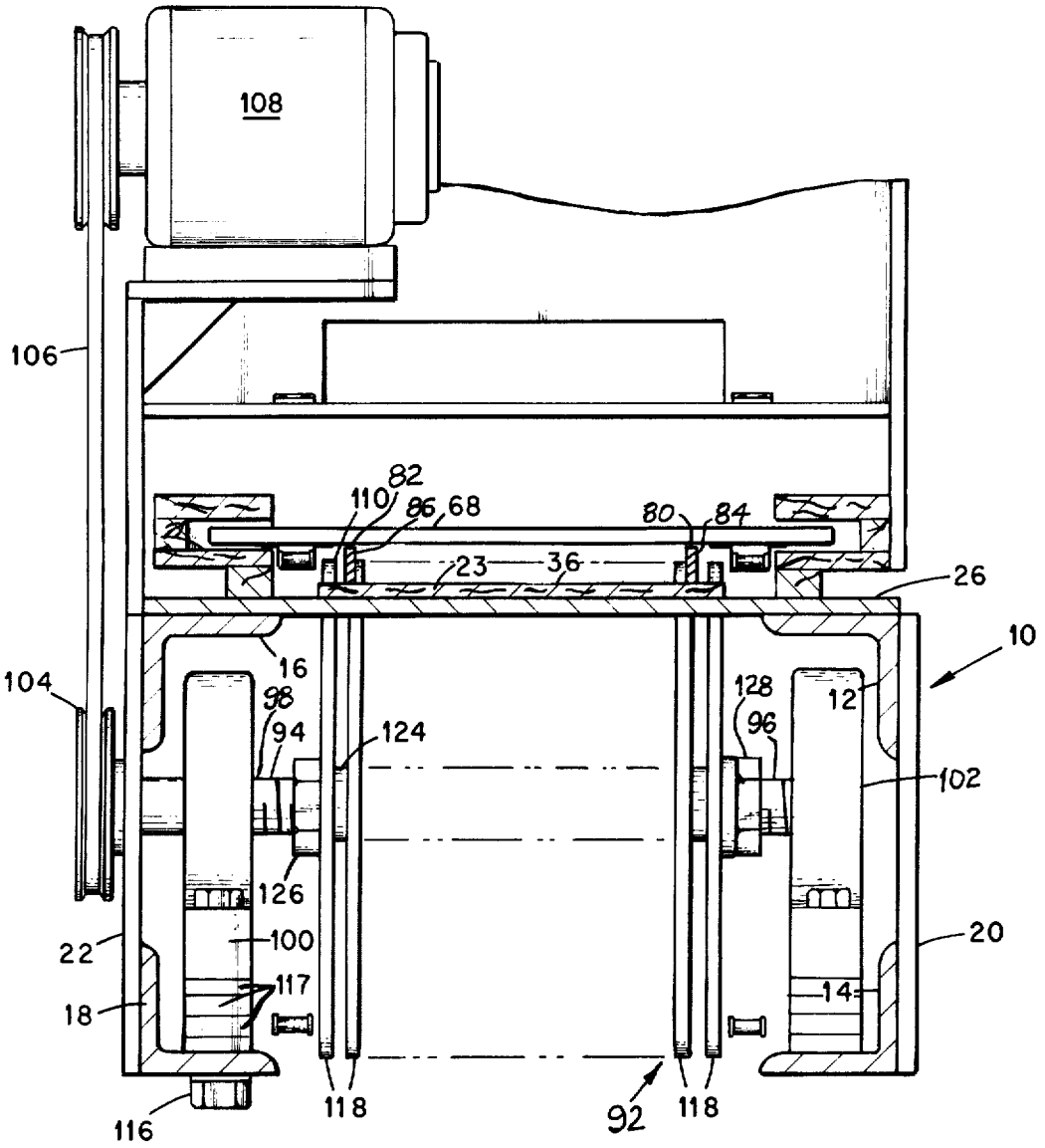
FIG. 3 is a sectional view, partly fregmentary, taken generally along line 3—3 of FIG. 1.
Figure 4:
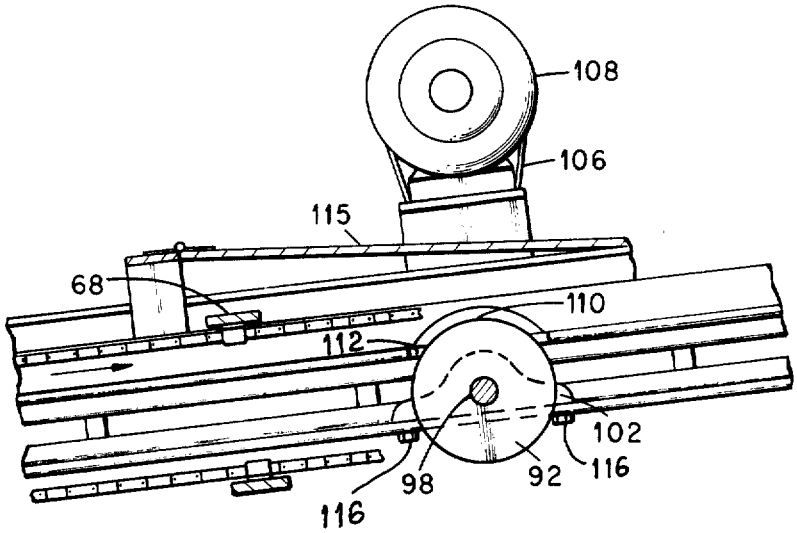
FIG. 4 is a fragmentary sectional side view, partly cut-away, of the first grinding station of the device shown in FIG. 1.
Figure 5:
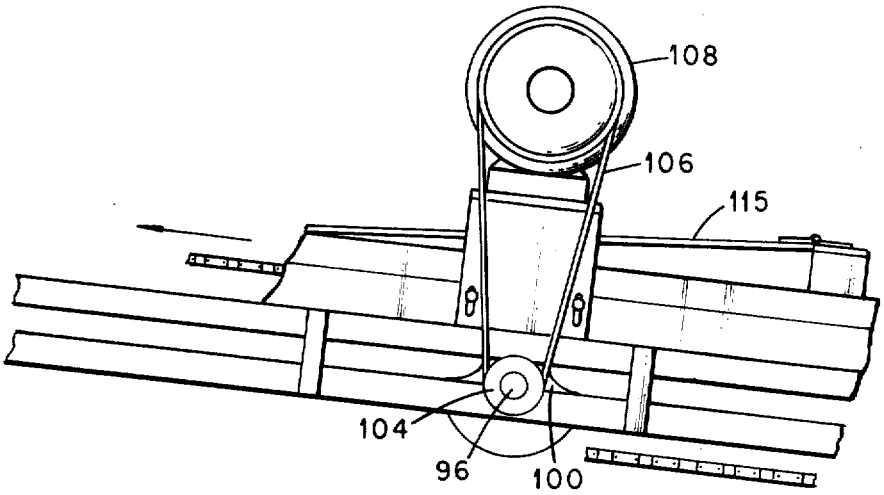
FIG. 5 is a fragmentary rear side view of the first grinding station.

With reference to FIGS. 1, 2 and 3, one embodiment of the apparatus disclosed herein includes an elongated frame 10 including elongated side members 12 and 14, defining one side margin of the frame and elongated side members 16 and 18 that define the opposite side margin. The side members 12 and 14 are joined together by upright braces 20 disposed at locations along the length of the side members. In like manner, the opposite side members 16 and 18 are joined by braces 22. A general planar slide 23 adapted to receive bricks 24 thereon is supported on cross members 26 that extend laterally between the side members 12 and 16 to bridge the space therebetween and connect the opposite side members to one another. This slide member 23 extends substantially the full length of the frame 10 and in a preferred embodiment is of a width greater than the long dimension of a brick. Guide means 34 is provided on the upper surface 36 of the slide 23 to maintain bricks in position for sliding movement along a path defined by the length of the slide. In the preferred embodiment, the bricks are positioned with their longitudinal dimension oriented substantially perpendicular to the forward direction of movement of the bricks along the slide. The bricks are loaded onto the slide at a loading station 38 adjacent the rear end 41 of the slide with one flat face 42 of each brick, usually with a quantity of mortar 44 clinging to it, facing downwardly and resting on the slide.

Disposed along each of the opposite side margins 46 and 48 of the slide, there is provided a pair of chains 50 and 52. These chains are trained about a set of sprockets 54 and 56 located adjacent the rear end 41 of the frame and a further set of sprockets 58 and 60 located adjacent the forward end 62 of the frame, thereby forming continuous loops along the opposite side margins of the slide. The sprockets 58 and 60 are fitted on a shaft 64 (not shown) that is journaled at its ends to the frame 10. The sprockets 54 and 56 at the rear end of the frame are similarly fitted on a shaft 66 that is journaled to the frame. A plurality of elongated cross members 68 are connected at their respective opposite ends 70 and 72, for example, to the chains 50 and 52. These cross members are located at spaced intervals along the looped chains and extend from one chain to the other across the slide. Each cross member is of a thickness less than the nominal thickness of a brick for reasons which will be apparent hereinafter.

The chains 50 and 52 are driven synchronously as by a motor 74 (which may be electric, gas or the like), connected through a gear reducer 76 and a chain means 78 to the shaft 66 on which the sprockets 54 and 56 are fitted. As the chains are driven, they carry the cross members 68 along the length of the slide. In the depicted embodiment, each of the cross members as it moves onto the rear end of the slide, engages a pair of inclines 79 and 81 that raise the cross member to a vertical height sufficient to cause the cross member to overlie and ride on the top edges 80 and 82 of the guides 84 and 86 that also serve to maintain the bricks in position on the slide. The vertical height of each of the guides 84 and 86 above the top surface 36 of the slide is chosen such that the cross member 68 is positioned above the slide by a distance at least as great as the nominal thickness of a common brick bed mortar joint, specifically approximately one-half inch. Accordingly, as the chains are driven, the cross member 68 contacts the rear surface 88 of a brick and pushes the brick along the length of the slide.

A first grinding station 90 is located on the slide forwardly of the loading station and includes a grinding roll 92 having a shaft 94 whose opposite ends 96 and 98 are mounted for rotation on the frame as by the use of pillow blocks 100 and 102. One end 96 of the shaft 94 is provided with a pulley 104 which is drivingly connected by a belt 106 to a motor 108. The mounting of the roll 92 is selected such that the top grinding edge 110 of the roll extends upwardly through an opening 112 in the slide 23 to a vertical height of about one-half inch, i.e., the nominal thickness of a mortar joint, above the top surface 36 of the slide.

The pillow blocks 100 and 102 are secured to the bottom side of the frame 10 as by means of the bolts 116. The vertical height of the top grinding edge 110 is established by adjusting the spacing between the pillow blocks and the frame 10. This is accomplished by insertion or removal of spacers, such as washers 117, between the pillow blocks and the frame.

In the first grinding station there is provided a weighted plate 115 hingedly connected to the frame 10 at a location immediately above the grinding roll 92. As the bricks are advanced across the first grinding roll 92 by the cross member 68, the weighted plate 115 engages the top surface of the brick and urges the brick downwardly against the grinding roll 92 with a force sufficient to ensure that the roll 92 removes the desired quantity of mortar from the bottom surface of the brick.

The grinding roll 92, depicted in its preferred embodiment in FIG. 3, comprises a plurality of abrasive discs 118, each of about seven inches in diameter, mounted in face-to-face, but spaced apart relationship, on the shaft 94. As depicted, the shaft is threaded at each of its ends 96 and 98. The discs 118 are fitted onto the shaft with a spacer 124 disposed between adjacent discs. Nuts 126 and 128 are provided on each of the threaded ends of the shaft and when tightened, they serve to keep the discs tightly frictionally joined so that they turn with the shaft as a unit.

It is to be understood that it is important to a brick mason that the bricks which he is laying be uniform in thickness so he can know that if he applies a uniform quantity of mortar to each brick, he will obtain a horizontally level run of bricks. It is much less important that the brick be completely free of old mortar. Accordingly, in the present device, the preferred disc 118 employed in the depicted apparatus is of a coarse grit, such as a seven inch diameter SAFTEX SPIN-ON, grade A24U, manufactured by Federal-Mogul, Chicago, Illinois. This grit has been found to break away the mortar from a brick in relatively small pieces, as well as in smaller pieces of "dust" size. By reason of the lateral spacing of the discs apart from each other, these dislodged pieces of mortar are propelled into the spaces between the discs and swept away. In this manner, the abrasive surface of each disc is kept clear of debris and does not "load up" due to accumulation of mortar in the abrasive surface, with consequential loss of abrasive capability. At the same time the abrasive discs do not dislodge relatively large pieces of mortar so that there is maintained a control over the extent of mortar removal, contrary to the use of toothed blades which tend to chip away mortar in chunks of uncontrolled size. In accordance with a further feature, the lateral spacing of the discs and the thickness of individual discs are chosen to provide for the cutting of grooves in the old mortar, each groove being less than approximately one-fourth inch in width (about equal to the thickness of a disc) and spaced apart from adjacent grooves by less than approximately one-fourth inch (about equal to the lateral space between adjacent discs). This relationship of groove width and spacing has been found advantageous in that such provides for sure removal of adequate mortar with minimum consumption of the abrasive discs. It further provides uniformly high ridges between adjacent grooves which define one "face" of the reclaimed brick. This described control over the degree of mortar removal is important in developing used bricks that are of uniform thickness so that a brick mason can efficiently lay the bricks in a wall or the like. Unexpectedly, it has been found that the grooves cut in the mortar on a brick when using the disclosed grinding rolls enhance the application of fresh mortar, apparently serving to receive and hold the fresh mortar as it is troweled onto the brick by the mason.

After having been moved passed the first grinding roll, either all the mortar is gone from the bottom face of each brick or any mortar remaining on the brick is grooved with the upstanding edges of the grooves collectively defining a substantially planar face on the bottom of the brick. The planar face rests on the slide which now becomes a "datum" surface for regulating the extent of mortar removal from the top surface of the brick.

A second grinding station 130 is provided forwardly of the first grinding station 90. This second grinding station is designed to remove mortar from the upper flat face 132 of a brick and comprises a grinding roll 134, that is of substantially identical construction as the previously described roll 92, including a shaft 94' whose opposite ends 136 and 138 are mounted for rotation in pillow blocks 140 and 142 that are secured on the outboard ends 144 and 146 of arms 148 and 150. The opposite ends 153 and 154 of the arms 148 and 150 are pivotally mounted to a shaft 156 that is mounted for rotation on the frame 10 by pillow blocks 150 and 160. The shaft 156 extends across the slide 23 with its longitudinal axis aligned substantially parallel with the longitudinal axis of the shaft 94' of the roll 134. One end 136 of the shaft 94' of the roll 134 is provided with a pulley 162 that is drivingly connected by a belt 164 to a pulley 166 mounted on one end 168 of the shaft 156. The opposite end 170 of the shaft 156 is similarly provided with a pulley 172 that also is drivingly connected by a belt 174 to a pulley 176 mounted on the end 138 of the shaft 94'. The shaft 156 is provided with a further pulley 180 that is drivingly connected by a belt 182 to a motor 184 that in the depicted embodiment is mounted on a plate 186 supported over the frame 10 as by posts 188, 190, 192 and 194 (not shown). Preferably there is provided a cover 196 which surrounds the second grinding station.

By reason of its pivotal mounting, the grinding roll 94' is free to move toward and away from bricks moved between the roll and the slide. In the depicted embodiment, the roll moves generally up and down. Using the disclosed type grinding roll, it has been found that the weight of the roll itself is sufficient to keep the roll in contact with the bricks with an applied force adequate to remove the desired mortar. The bottom limit of travel of the roll is established by a jack screw 198 mounted on the frame 10 and extending upwardly to engage the arm 10 on which the roll 94' is mounted. A like jack screw 200 is provided to halt the downward movement of the arm 150 on the opposite end of the roll.

In the depicted embodiment, the slide 23 is provided with slots 201 forwardly of the second grinding station, through which particles of removed mortar may fall thereby preventing accumulation of such particles such as may impede sliding of the bricks.

The frame 10 preferably is supported on wheel means 202 and 204. A pair of frame members 206 and 208 are pivotally connected to the opposite sides of the frame 10 at locations disposed toward the rear end of the frame and extend downwardly to be joined to collars 210 and 212 (not shown) that circumscribe an axle 214 extending between wheels 216 and 218. The collars 210 and 212 are rotatable about the axle. The forward end of the frame is connected to the axle 214 by frame members 220 and 222 that are joined at one of their ends to the collars 224 and 226 (not shown) that also circumscribe the axle 214, and extend upwardly and forwardly from the axle to terminate on the underside of the frame 10. The terminal ends 228 and 230 of these frame members are provided with rollers 232 and 234 (not shown) adapted to engage and support the frame while permitting the points of engagement of the rollers with the frame to be changed.

The rear frame members 206 and 208 are connected by a cross member 236. Similarly, the forward frame members are connected to each other by a cross member 237. These two cross members are connected to each other in the depicted embodiment by a cable 238 having its free end 240 attached to the cross member 237 and extending therefrom to wrap a pulley 242 attached to the cross member 236, thence to a winch device 244 mounted on the cross member 237, adjacent the free end of the cable. By this means, the rear frame members 206 and 208 and the forward frame members 220 and 222 may be drawn toward each other in a scissoring action to change the angle of inclination of the frame for expelling cleaned bricks directly into a truck or the like, for example.

A further set of wheels 246 and 248 is provided adjacent the rear end of the device in one embodiment to enhance the mobility of the device during field operations.

In the depicted embodiment, the rear end of the frame 10 includes a rearwardly projecting platform 250 that is affixed to the side frame members 14 and 18 as by extensions 252 and 254. This platform serves to mount the motor 74 and related elements of the system employed to drive the chains 50 and 52. This platform also serves to mount the wheels 246 and 248.

In a typical operation of the present apparatus, the motors 74, 108, and 184 are turned on to activate the chains 50 and 52 and to commence rotation of the grinding rolls 92 and 134. The direction of rotation of the grinding roll 92 is counter to the direction of forward movement of bricks being cleaned (counterclockwise as viewed in FIG. 1). Likewise, the rotation of the grinding roll 134 is counter to the direction of brick movement (clockwise as viewed in FIG. 1).

Bricks are loaded by hand onto the rear end of the slide within the confines of the guide means 34. In the preferred embodiment, each brick is oriented with its longitudinal dimension oriented generally perpendicular to the direction of forward movement of the brick along the length of the slide. It is recognized, however, that the bricks may be oriented with their longitudinal dimension generally parallel in the direction of their forward movement. Such latter orientation of the brick is less desirable by reason of the control which can be exerted over the position of the brick as it passes through the grinding operations. Preferably, several bricks are placed on the slide with their side faces 256 and 256' abutting so that they are moved through the grinding operation as a unit.

As the chains rotate, the cross member 68 attached to the chains is advanced from the rear toward the forward end of the slide. As the cross member approaches the bricks positioned on the slide, it rides upwardly on the inclines 79 and 81 and onto the top edges of the guides 84 and 86 to position the cross member such that it contacts the rear face 88 of the most rearward brick along substantially the horizontal mid-line of the brick. Upon advancement of the cross member due to forward rotation of the chains, the bricks are caused to slide along the slide 23 and pass over the grinding roll 92 in the first grinding station 90. The bricks are urged downwardly against the grinding roll 92 by the hinged plate 115 to insure that the brick bears against the grinding roll such that the mortar on the bottom face of the brick is ground away. Notably, in the first grinding station, the cross member 68 continues to ride on the top edges of the guide members 84 and 86 so that the grinding roll does not contact the cross member. Further, the thickness of the cross member is less than the thickness of the brick so that the plate 115 can effectively bear against the bricks.

As the bricks are further advanced along the slide, they pass underneath the second grinding roll 134 in the second grinding station 130. The weight of the grinding roll 134 causes it to bear downwardly against the mortar clinging to the upper face of each brick and to grind away such mortar. This grinding action is of a nature such that as a brick passes beneath the grinding roll, the weight of the roll and the abrasive capability of the discs cut through any mortar on the brick face and the roll moves downwardly to engage the jack screws 198 and 200. Recalling that the bottom face of the brick has passed over the first grinding roll 92 and has had the mortar removed from the bottom face, such bottom face slides along the slide 23 which serves as a bottom datum surface for movement of the brick beneath the second grinding roll 134. Accordingly, when the second grinding roll cuts through the mortar on the top face of the bricks and comes to rest against the jack screws which limit the vertically downwardly movement of the grinding roll 134, the bottom cutting edges of the second cutting roll are at an established vertical height above the top surface 36 of the slide 23 so that the thickness of the brick is established at a constant value.

The cleaned bricks are further advanced by the moving cross member and expelled from the forward end of the slide. As indicated hereinabove, the angle of inclination of the slide 23 can be adjusted such that the bricks can be expelled into a truck or the like.

What is claimed is:

1. Apparatus for removing mortar from opposite flat surfaces of used brick comprising, in combination, elongated planar means defining a path supporting said brick on one of its flat faces thereon for forward movement along said path, means adapted to advance said brick forwardly along said path including a pair of loop members drivingly connected for synchronous movement along paths substantially parallel to the forward path of said brick and including an elongated cross member connected at its opposite ends to said loop members and extending therebetween and engaging said brick during such forward movement, means adapted to elevate said cross member to a vertical height above said planar means a distance approximately equal to one-half the nominal thickness of a brick, said means comprising a pair of substantially parallel and spaced apart elongated guides disposed on said planar means and having upper surfaces on which said cross member rides, a first grinding station disposed at a location along the length of said path, said first grinding station comprising a first abrasive roll means having its rotational axis disposed generally transversely of the forward direction of movement of said brick, said rotational axis being disposed on the underside of said planar member such that a portion of the abrasive surface of said first abrasive roll projects above the upper surface of said planar member in position to abrasively contact the bottom surface of a brick moved along said path, relatively nonabrasive means overlying the path of said brick at a location adjacent said first abrasive roll means and resiliently biased toward engagement with the top face of said brick to urge its bottom face toward engagement with that portion of said first abrasive roll means that projects above the top surface of said planar member as said brick passes between said first roll means and said relatively nonabrasive means, a second grinding station disposed along the length of said path and spaced apart from said first grinding station, said second grinding station comprising a second abrasive roll means having its rotational axis disposed generally transversely of the forward direction of movement of said brick and above said planar member for passage of said brick between said second abrasive roll means and said planar member during forward movement of said brick with its previously ground bottom face disposed on said planar member, whereby said second abrasive roll means functions to remove mortar from the top face of said brick, and means mounting said second abrasive roll means for generally vertical movement thereof with respect to the forward path of said brick and resiliently biasing said second abrasive roll means downwardly toward said planar member.

2. The apparatus of claim 1 wherein said cross member is of a thickness less than the nominal thickness of a brick.

3. The apparatus of claim 1 wherein said first abrasive roll means and said second abrasive roll means each comprises a plurality of abrasive discs aligned in face-to-face and spaced apart relationship on a central shaft means.

4. The apparatus of claim 3 wherein said abrasive discs are spaced apart a distance of approximately one-fourth inch and each abrasive disc has a thickness of approximately one-fourth inch.

* * * * *